United States Patent [19]

Tanaka et al.

[11] Patent Number: 4,472,121

[45] Date of Patent: Sep. 18, 1984

[54] HORIZONTAL ROTARY COMPRESSOR WITH OIL FORCED BY GAS DISCHARGE INTO CRANKSHAFT BORE

[75] Inventors: Hideharu Tanaka, Amagasaki; Kōji Ishijima; Toshihide Kōda, both of Shizuoka, all of Japan

[73] Assignee: Mitsubishi Denki Kabushiki Kaisha, Tokyo, Japan

[21] Appl. No.: 309,493

[22] Filed: Dec. 8, 1981

Related U.S. Application Data

[63] Continuation-in-part of Ser. No. 099,727, Dec. 4, 1979, Pat. No. 4,355,963.

[30] Foreign Application Priority Data

Dec. 18, 1978 [JP] Japan ..... 53-166076
Jan. 5, 1979 [JP] Japan ..... 54-512

[51] Int. Cl.[3] ..... F04C 18/00; F04C 29/02; F16N 7/30; F16N 21/00

[52] U.S. Cl. ..... 418/63; 418/88; 418/94; 417/151; 417/902; 184/6.16

[58] Field of Search ..... 418/63, 88, 94, 97–100, 418/DIG. 1; 417/902, 151, 198; 184/6.16

[56] References Cited

U.S. PATENT DOCUMENTS 35,575 6/1862 Millholland ..... 417/198

FOREIGN PATENT DOCUMENTS 53-153518 2/1978 Japan ..... 418/94
105560 7/1924 Switzerland ..... 184/6.16
253156 6/1926 United Kingdom ..... 417/151

*Primary Examiner*—John J. Vrablik
*Attorney, Agent, or Firm*—Wenderoth, Lind & Ponack

[57] ABSTRACT

A horizontal rotary type compressor having a rotary compression unit hermetically contained in a closed shell has its lubricating parts effectively lubricated by lubricant oil being fed to the central lubrication bore formed axially in the crankshaft through a lubricant oil feed tube which is opened at one end within the lubricant oil accumulated on the bottom of the closed shell and adapted to be intermittently subjected to the refrigerant gas discharged from the compression unit.

6 Claims, 6 Drawing Figures

HORIZONTAL ROTARY COMPRESSOR WITH OIL FORCED BY GAS DISCHARGE INTO CRANKSHAFT BORE

This application is a continuation-in-part of application Ser. No. 99,727, filed Dec. 4, 1979 now U.S. Pat. No. 4,355,963.

BACKGROUND OF THE INVENTION

1. Field of the Invention

This invention relates to a rotary type compressor and more particularly to a lubrication system in a horizontal rotary type compressor.

2. Description of the Prior Art

Recently rotary type compressors have been widely used in household refrigerators, air-conditioning apparatuses, etc. because it is possible to make the compressor compact. In the field of application of rotary type compressors in refrigerators, etc. it is often the case that in installing it less space is required when it is installed horizontally, that is, when the peripheral side surfaces of its cylindrical outer configuration are laid horizontally rather than being installed otherwise.

In such a horizontal rotary type compressor the lubrication has hitherto been carried out in such a manner that the crankshaft was dipped in lubricant oil accumulated in the lower part of the closed shell and the lubricant oil was supplied to the various parts from the end of the crankshaft through a lubrication bore formed axially in the crankshaft by the use of a centrifugal lubricant oil pump, etc. connected to the crankshaft. However, in the case of a horizontal rotary type compressor, since the lubrication bore in the crankshaft is distant from the surface of the lubricant oil in the closed shell it has been a problem that such a lubrication system as is conventional in a vertical rotary type compressor can not be adopted.

SUMMARY OF THE INVENTION

It is an object of the present invention to provide a new lubrication system for a horizontal rotary type compressor.

It is another object of the present invention to provide a means which has a simple construction and is reliable in operation for supplying lubricant oil into a lubrication bore formed centrally and axially in the crankshaft of a horizontal rotary type compressor.

It is a further object of the present invention to provide a means for supplying lubricant oil into a lubication bore in a crankshaft of a horizontal rotary type compressor by the effective use of refrigerant gas discharged from the compression unit.

In accordance with the present invention a lubrication system for a horizontal rotary type compressor is provided in which lubricant oil accumulated in the bottom of a closed shell within which the compression unit is contained is supplied into the lubrication bore formed centrally and axially in the crankshaft by the effective use of the pulsation of a refrigerant gas under high pressure discharged from the compression chamber. For this purpose the horizontal rotary type compressor according to the present invention is provided with a lubricant oil feed tube, one end of which is in communication with the lubrication bore in the crankshaft, the other end of which is opened in the lubricant oil in the closed shell, and a refrigerant gas discharge pipe, one end of which is put within one end of the lubricant oil feed tube opened into the lubricant oil, the other end of which is in communication with the refrigerant gas discharged from the compression chamber.

BRIEF DESCRIPTION OF THE DRAWINGS

The above brief description, as well as further objects, features and advantages of the present invention will be more fully understood by reference to the following detailed description of the presently preferred, but nonetheless illustrative embodiments in accordance with the present invention, when taken in conjunction with the accompanying drawings, wherein.

DESCRIPTION OF THE PREFERRED EMBODIMENTS

Figure 1:
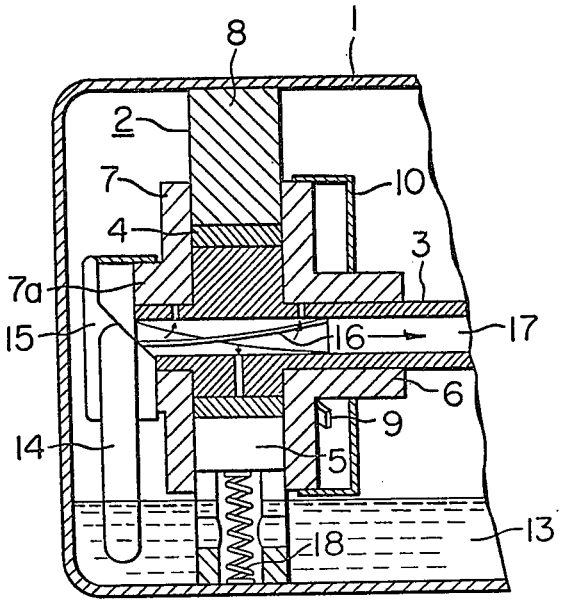
FIG. 1 is a longitudinal sectional elevational view of one embodiment of a horizontal rotary type compressor in accordance with the present invention.
Figure 2:
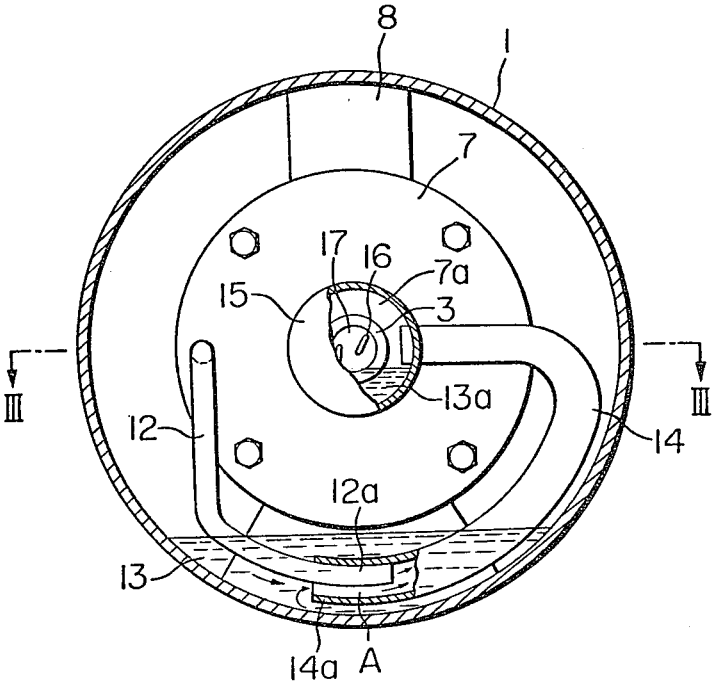
FIG. 2 is a longitudinal, partial sectional side view of the compressor shown in FIG. 1.
Figure 3:
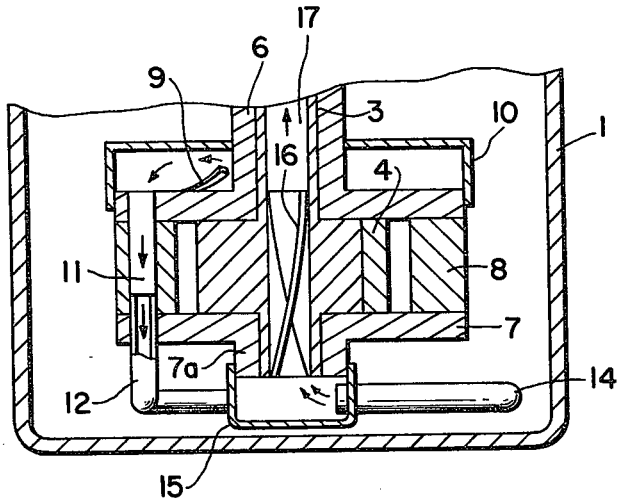
FIG. 3 is a cross-sectional view taken along the line III—III of FIG. 2.
Figure 4:
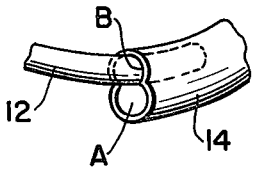
FIG. 4 is a partial perspective view showing the formation of the lubricant oil induction gap formed between a refrigerant gas discharge pipe and a lubricant oil feed tube.

FIGS. 1 to 4 show one embodiment of the present invention wherein there is provided a closed shell 1, in which is contained a rotary compressor unit 2 which comprises a crankshaft 3 to be driven by an electric motor (not shown) or the like, a rolling piston 4 fitted on it, a vane 5 abutting at one end against piston 4 and adapted to be reciprocated by the eccentric motion of piston 4, a frame 6 as well as a cylinder head 7 to support crankshaft 3, and a cylinder 8 disposed between frame 6 and cylinder head 7. As well known in the art the inside of cylinder 8 is divided into a suction chamber and a compression chamber for a refrigerant gas by vane 5 so that the suction and the delivery of the refrigerant gas are repeated by the eccentric rotational motion of piston 4. Thus, the compressed refrigerant gas is discharged into a discharge-side silencer chamber 10 outside frame 6 through a discharge valve 9, flowing therefrom through a refrigerant gas orifice 11 formed through frame 6, cylinder 8 and cylinder head 7 as shown in FIG. 3 to be led into a refrigerant gas discharge pipe 12 one end of which is fitted in refrigerant gas orifice 11 to be fixedly secured to cylinder head 7, thereafter it passes through discharge pipe 12 and flows to the gas discharge end **12*a*. As shown in FIGS. 2 and 4 gas discharge end 12*a* of refrigerant gas discharge pipe 12 opens within one end 14*a* of a lubricant oil-gas feed tube 14 opening within or below the surface level of lubricant oil 13 accumulated on the bottom of closed shell 1. The other end of lubricant oil-gas feed tube 14, one end 14*a* of which is immersed in lubricant oil 13, opens into a bell-shaped lubricant oil-gas reservoir container 15 for feeding lubricant oil and gas mixed therewith which is mounted on cylinder head 7 so as to enclose a cylindrical part 7*a* projecting from the outer wall of cylinder head 7**.

Therefore, since the refrigerant gas discharged from the compression chamber is discharged through gas discharge end **12*a* of refrigerant gas discharge pipe 12 into one end 14*a* of lubricant oil-gas feed tube 14, lubricant oil 13 accumulated in the lower part of closed shell 1 and mixed with gas is forced into lubricant oil-gas feed tube 14 through a gap A formed at the overlapping end portions 12***a* and 14*a* of refrigerant gas discharge pipe 12 and lubricant oil-gas feed tube 14 so that it is supplied into oil-gas reservoir container 15 together with the discharged refrigerant gas. Lubricant oil 13*a* thus collected in oil-gas reservoir container 15 is forced into a central lubrication bore 17 formed axially in crankshaft 3 by a screw blade 16 provided at one end thereof to be supplied to various shifting portions in a manner known per se. In FIG. 1 the reference numeral 18 shows a vane spring to thrust vane 5 against piston 4.

As shown in FIG. 4, the end of oil-gas feed tube 14 is shaped so as to have two substantially circular cross-sectional portions connected to each other, whereby a lubricant oil induction opening A and an engaging opening B for receiving refrigerant gas discharge pipe 12 in the lubricant oil-gas feed tube 14 are provided. The pipe 12 can be secured in the opening B by a force fit or by welding, brazing adhesive, or the like. This makes it possible to secure refrigerant gas discharge pipe 12 to lubricant oil-gas feed tube 14 more reliably while the existence of the lubricant oil induction opening A is ensured.

Figure 5A:
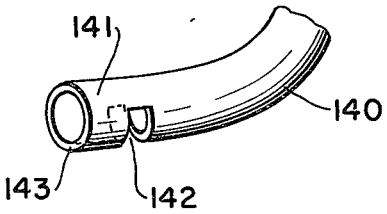
FIGS. 5A and 5B are views similar to FIG. 4 showing a modification of the construction shown in FIG. 4 and the manner of making it.
Figure 5B:
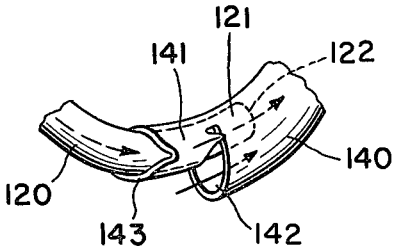

FIGS. 5A and 5B show a modification of the embodiment shown in FIGS. 1–4, in which, instead of having the end of the oil-gas feed tube 14 shaped with two substantially circular cross-sectional portions, the end of the oil-gas feed tube 140 has a transverse slot 142 cut therein around substantially half the periphery thereof, and spaced from the end 143 of the tube 140 and for attaching the pipe 120 to the tube 140, the end of the pipe 120 is inserted into the end of the tube 140 the desired distance and the portion of the periphery of the end of the tube 140 between the slot 142 and the end portion of the tube 140 between the slot 142 and the end 143 is flattened against and around the end of the pipe 120 as shown at 141 for securely gripping and holding the pipe 120 in the tube 140. Brazing can be used if a more secure attachment is needed.

In both embodiments, the gas mixed with the oil is returned to the interior of the shell through openings (not shown) and the gas is discharged from the casing through a discharge opening (not shown).

From the foregoing it will be appreciated that according to the present invention the feed of the lubricant oil to a crankshaft of a horizontal rotary type compressor is made possible by the effective use of the compressed refrigerant gas discharged from the compression chamber so that the problems concerning lubrication in a horizontal rotary type conpressor can be resolved.

The invention has been described with particular reference to the preferred embodiments, but it will be understood that variations and modifications within the spirit and scope of the invention may occur to those skilled in the art to which the invention pertains.

We claim:

1. A horizontal rotary type compressor comprising:

a closed shell;

a rotary compression unit housed within said closed shell, said rotary compression unit having a cylinder, a cylinder head and a frame enclosing both ends of said cylinder, a piston eccentrically rotatable in said cylinder about an axis extending horizontally, a crankshaft fitted in said piston and having a central axial lubrication bore, and a vane dividing the space defined within said cylinder by said piston, cylinder head and frame into a suction chamber and a compression chamber;

said rotary compression unit further having a refrigerant gas discharge port;

a refrigerant gas discharge pipe connected at one end to said refrigerant gas discharge port and having the other end at the bottom of said closed shell so as to be below the surface level of lubricant oil accumulated in the bottom of said closed shell; and a lubricant oil-gas feed tube extending along a central longitudinal axis and having one end disposed at the bottom of said closed shell so as to be below the surface level of the lubricant oil in the bottom of said closed shell and having the other end opening into said central lubrication bore in said crankshaft, said other end of said refrigerant gas discharge pipe extending into said one end of said lubricant oil-gas feed tube parallel to said longitudinal axis, the one end of said lubricant oil-gas feed tube having a portion thereof tightly gripping said other end of said refrigerant gas discharge pipe and the remainder of the one end of said lubricant oil-gas feed tube forming a longitudinally opening oil inlet, whereby the lubricant oil accumulated in the bottom of said closed shell is supplied to said lubrication bore in said crankshaft by the injection of refrigerant gas discharged from said compression chamber into said lubricant oil-gas feed tube through said refrigerant gas discharge pipe.

2. A compressor as claimed in claim 1 in which the said one end of said lubricant oil-gas feed tube has two substantially circular cross-sectional portions connected to each other, the said other end of said refrigerant gas discharge pipe being tightly gripped in one of said portions and the other of said portions constituting said oil inlet.

3. A compressor as claimed in claim 1 in which said one end of said lubricant oil-gas feed tube has a slot therein around a part of the periphery thereof, and the portion of said tube between said slot and the end of said tube is flattened against and around the other end of said refrigerant gas discharge pipe for tightly gripping said other end, the portion of the cross-section of said tube along which said slot extends constituting said oil inlet.

4. A compressor as claimed in claim 1, wherein said portion and said remainder of said one end both open in a direction parallel to the longitudinal axis of said lubricant oil-gas feed tube.

5. A compressor as in claim 4, wherein said one end of said lubricant oil-gas feed tube is formed from a cylindrical wall which includes a first side wall portion and a second side wall portion diametrically opposite said first side wall portion in a direction perpendicular to said longitudinal axis, said other end of said refrigerant gas discharge pipe being offset from said longitudinal axis toward said first side wall portion, said first side wall portion being deformed so that only said first side wall portion tightly grips said other end of said refrigerant gas discharge pipe, said refrigerant gas discharge pipe and said second side wall portion bounding said oil inlet.

6. A horizontal rotary type compressor comprising:

a closed shell;

a rotary compression unit housed within said closed shell, said rotary compression unit having a cylinder, a cylinder head and a frame enclosing both ends of said cylinder, a piston eccentrically rotatable in said cylinder about an axis extending horizontally, a crankshaft fitted in said piston and having a central axial lubrication bore, and a vane dividing the space defined within said cylinder by said piston, cylinder head and frame into a suction chamber and a compression chamber;

said rotary compression unit further having a refrigerant gas discharge port;

a refrigerant gas discharge pipe connected at one end to said refrigerant gas discharge port and having the other end at the bottom of said closed shell so as to be below the surface level of lubricant oil accumulated in the bottom of said closed shell; and a lubricant oil-gas feed tube having one end disposed at the bottom of said closed shell so as to be below the surface level of the lubricant oil in the bottom of said closed shell and having the other end opening into said central lubrication bore in said crankshaft, said other end of said refrigerant gas discharge pipe extending into said one end of said lubricant oil-gas feed tube, the one end of said lubricant oil-gas feed tube having a portion thereof tightly gripping said other end of said refrigerant gas discharge pipe and the remainder of the one end of said lubricant oil-gas feed tube forming an oil inlet, whereby the lubricant oil accumulated in the bottom of said closed shell is supplied to said lubrication bore in said crankshaft by the injection of refrigerant gas discharged from said compression chamber into said lubricant oil-gas feed tube through said refrigerant gas discharge pipe, said one end of said lubricant oil-gas feed tube having a slot therein around a part of the periphery thereof, and the portion of said tube between said slot and the end of said tube is flattened against and around the other end of said refrigerant gas discharge pipe for tightly gripping said other end, the portion of the cross section of said tube along which said slot extends constituting said oil inlet.

* * * * *